US008242343B2

(12) United States Patent
Jones et al.

(10) Patent No.: US 8,242,343 B2
(45) Date of Patent: Aug. 14, 2012

(54) DRUM MOUNT

(75) Inventors: Nicholas Pierce Jones, Westfield, MA (US); Jonathan Ralph Jones, Granville, MA (US)

(73) Assignee: Noble & Cooley, Granville, MA (US)

( * ) Notice: Subject to any disclaimer, the term of this patent is extended or adjusted under 35 U.S.C. 154(b) by 685 days.

(21) Appl. No.: 12/481,077

(22) Filed: Jun. 9, 2009

(65) Prior Publication Data

US 2010/0307316 A1 Dec. 9, 2010

(51) Int. Cl.
*G10D 13/02* (2006.01)

(52) U.S. Cl. ..... 84/421

(58) Field of Classification Search ..... 84/411 R, 84/421; 248/220.21, 223.41, 225.21
See application file for complete search history.

(56) References Cited

U.S. PATENT DOCUMENTS

2010/0213333 A1* 8/2010 Mejia et al. ..... 248/220.21
2010/0264102 A1* 10/2010 Barkdoll et al. ..... 211/106.01
2011/0024585 A1* 2/2011 Brinkdopke et al. ..... 248/205.4

OTHER PUBLICATIONS

Gibraltar Tom Mounting Brackets Super L-Rod Tom Mount Key Tighen, JC Percussion, http://www.jcpercussion.com, Mar. 26, 2009.

* cited by examiner

*Primary Examiner* — Kimberly Lockett
(74) *Attorney, Agent, or Firm* — McCormick, Paulding & Huber LLP

(57) ABSTRACT

A mount for mounting and affixing an object to a supporting structure, for example, a drum to a drum stand. The mount includes a hanger plate that mounts to the drum and a bracket that mounts to the drum stand. The hanger plate has a downwardly depending L-shaped flange that is received by a cavity in the bracket. Once inserted into the cavity, the weight of the drum translates through the flange to form a locking engagement of the drum to the drum stand such that the drum is supported substantially adjacent to the drum stand.

20 Claims, 5 Drawing Sheets

DRUM MOUNT

FIELD OF THE INVENTION

The invention relates to device for mounting and affixing objects to a support structure and, in particular, a drum mount for mounting and affixing drums to a drum stand.

BACKGROUND OF THE INVENTION

Instruments, particularly percussion instruments, are often mounted to a supporting structure, such as an instrument stand or rack, so that the musician can readily access a number of individual instruments in an organized manner. One such instrument is a drum, which, when assembled on a supporting structure, forms a drum set. A simple drum set might include a bass drum supported on the floor, a snare drum supported on a floor-mounted stand as well as two tom-toms and two cymbals fixedly mounted to a drum stand. However, much more elaborate and complex drum sets are common. As the drum set increases in complexity, the number of drums (including bass drums, snare drums, tom-toms, etc.) attached to the drum stand increases. This occurs, in part, because of the need to create and maintain a fixed and organized arrangement of percussion elements (including drums, cymbals, etc.) from one session to the next.

In such drum sets, a drum is attached to the drum stand using a clamp. Specifically, the clamp is mounted to the drum and is attached to a cylindrical holding rod that protrudes from the drum stand and acts as an anchor for elements, such as a drum, to be affixed to the drum stand. Holding rods can be either fixed or adjustable relative to the drum stand. The clamps known in the art are generally designed to provide maximum adjustability along with a tight fitting and stable connection between the drum and the drum stand.

It is, therefore, common to use clamps that include a screw locking mechanisms. In particular, the clamp is attached to the holding rod and a cylindrical groove is exposed for receiving a bar attached to the drum. The bar is held within the cylindrical groove using a screw locking mechanism, which has a screw aligned on the opposing side of the bar from the cylindrical groove. The screw locking mechanisms often have an enlarged tab or a pair of wings on the distal end of the screw—or opposing bolt, if present—so that the screw can be adjusted by hand. However, tools (e.g., a screw driver and/or a wrench) may be necessary to provide the proper level of tightness and, thus, locking engagement.

Setting up the drum set can require a significant amount of time. Each drum must be attached to the drum stand by hand. This requires that the corresponding clamp be secured to the holding rod by inserting the holding rod into an aperture in the clamp and, then, tightening the screw locking mechanism to engage the holding rod.

Once all of the drums are attached, it may still be necessary to adjust the drum set if the drums are not properly arranged. This requires loosening or detaching a number of clamps, positioning the corresponding drum in the proper arrangement and attaching the clamp to the holding rod to form a secure connection.

In addition, taking down the drum set after use is similarly time consuming. Each clamp must be loosened by hand or using the same tools used to provide the desired level of tightness.

The time expended to set-up a drum set, adjust the drum set to be in the proper arrangement and take-down the drum set after use is exacerbated by the need to provide a very tight and secure attachment between the drum and the drum stand.

There is a commonly held belief in the art that the drum must be tightly and securely attached to the drum stand, to the greatest extent possible. It is thought that a loose connection will negatively impact the acoustic properties of the drum set, for instance, by causing rattling, reducing tonal clarity and increasing drum shaking and bounce, which impedes the user's ability to properly strike the surface of the drum.

Another reason for this belief is that a loose connection using known clamps is more likely to result in a shifting movement of the drums relative to the drum stand during use, which will impact the user's ability to perform and result in an interruption of use. For example, as the drums move out of the proper arrangement during use, it becomes necessary to adjust the position and orientation of the drums as was required during and/or immediately subsequent to set-up. Exacerbating the problem, the amount of force required to tighten the fastener to the desired level of locking may result in the inadvertent actuation of another adjustable element of the drum stand.

An additional problem arises in that frequent set-up, adjustment, and take-down of the drum set causes wear upon the clamp and the holding rod as a matter of routine use. In particular, the screw locking mechanisms become increasingly loose, which requires additional effort to provide the desired level of tightness, and the holding rods become pitted or stripped, which impedes the tightening of the clamp thereto. Wear and tear is of particular significance to drum sets because precise and uniform arrangement of drums is desired from one session to the next and the degradation of the connection between the drum and the drum stand results in more frequent and significant movement of the drums relative to the drum stand.

SUMMARY OF THE INVENTION

An object of the present invention is, therefore, to provide an improved drum mount, which, among other desirable attributes, significantly reduces or overcomes the above-mentioned deficiencies of prior clamp and holding rod engagements.

It is an object of the present invention to provide a device (e.g., a drum mount) for affixing and mounting a drum to a drum stand.

It is an object of the present invention to provide a drum mount that is operable and back-compatible with drums and drum stands that are known in the art.

It is an object of the present invention to provide a drum mount that is cheap and simple to manufacture.

It is an object of the present invention to provide a drum mount that affixes and mounts the drum to the drum stand more quickly and easily than known clamps.

It is an object of the present invention to provide a drum mount that maintains the acoustic properties of the drums.

It is an object of the present invention to provide a drum mount to provide a drum-to-drum stand attachable/detachable connection that is independent from the connection to the holding rod.

It is an object of the present invention to provide a drum mount that maintains the arrangement of the drum set during use.

It is an object of the present invention to provide a drum mount that reduces routine wear and tear by minimizing the amount of set-up, adjustment and take-down activities between sessions.

Accordingly, the present invention provides a mount for affixing an object to a support structure, the mount including: a hanger plate having a body portion including a front surface for affixing to the object and a substantially L-shaped flange protruding from a rear surface of the body portion; and a bracket affixed to the support surface and having a substantially vertical cavity fitted to receive the flange; wherein the object is supported adjacent to the support structure when the flange is inserted into the cavity.

The present invention also provides an instrument set, the instrument set including: an instrument rack having at least one holding rod; at least one bracket affixed to the at least one holding rod having a cavity; at least one hanger plate having a flange that protrudes from the at least one hanger plate and is fitted to the cavity; and at least one instrument affixed to a body portion of the hanger plate, wherein the at least one instrument is supported adjacent to the instrument rack when the flange is inserted into the cavity.

The present invention also provides a mount for affixing an instrument to an instrument stand, wherein the instrument has an outer cylindrical surface and the instrument stand supports at least one holding rod, including: an hanger plate having a substantially rectangular body portion fitted to receive the outer cylindrical surface of the drum and an L-shaped flange, wherein the flange includes: a stand off portion that extends perpendicularly outward from the body portion away from the instrument, wherein the stand off portion is a substantially uniform thickness rectangular member with tapered edges along a bottom surface; and a downwardly depending portion extending downward from the stand off portion, wherein the downwardly depending portion is a substantially right angled triangular member that concludes in a rounded tip; and a bracket for mounting to the at least one holding rod including: a rear clamp having a front facing surface that includes a substantially vertical cylindrical rear recess for receiving a side of the at least one holding rod and at least one through bore; a front clamp having a rear facing surface that opposes the front facing surface, the rear facing surface including a substantially vertical cylindrical front recess for receiving an opposing side of the at least one holding rod and at least one bore corresponding to the at least one through bore, and a top surface that includes a horizontal recess fitted to receive the stand off portion and a cavity fitted to receive the downwardly depending portion and abutting the horizontal recess; and at least one fastener for connecting the rear clamp and the front clamp in adjustable locking engagement, wherein the at least one fastener is inserted through the at least one through bore and into the at least one bore; whereby the hanger plate is affixed to the bracket by inserting the flange into the horizontal recess and the cavity and the at least one instrument is supported adjacent to the instrument stand when the flange is inserted into the cavity.

In addition, it is an object of the present invention to provide a mount that includes a securing mechanism for resisting the separation or detachment of the object from the supporting structure.

DETAILED DESCRIPTION OF THE PREFERRED EMBODIMENTS

The present invention is directed to a drum mount for affixing and mounting a drum to a drum stand. A drum has a substantially cylindrical shape and is engageable, for instance, by inserting fasteners into holes in the outer annular surface. A drum stand can take on a range of shapes and sizes, and includes holding rods that are, preferably, cylindrical members provided at desired positions along the drum stand for mounting drums.

In general, the drum mount of the present invention includes an hanger plate (see FIGS. 1-5) for mounting to the drum and a bracket for mounting to a holding rod of the drum stand. The bracket includes a rear clamp (see FIGS. 6-10) and either a front clamp (see FIGS. 11-15) or a cantilever clamp (see FIGS. 16-20) in adjustable screw locking engagement with one another. The hanger plate and the bracket engage one another to affix and mount the drum to the drum stand.

Figure 1:
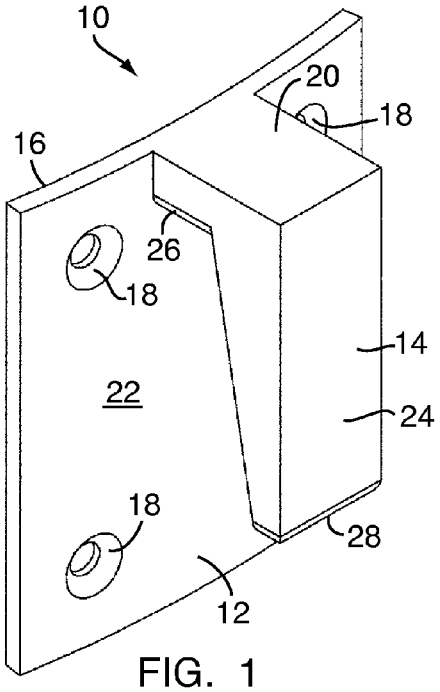
FIG. 1 illustrates a perspective view of the hanger plate according to the first embodiment of the present invention.
Figure 2:
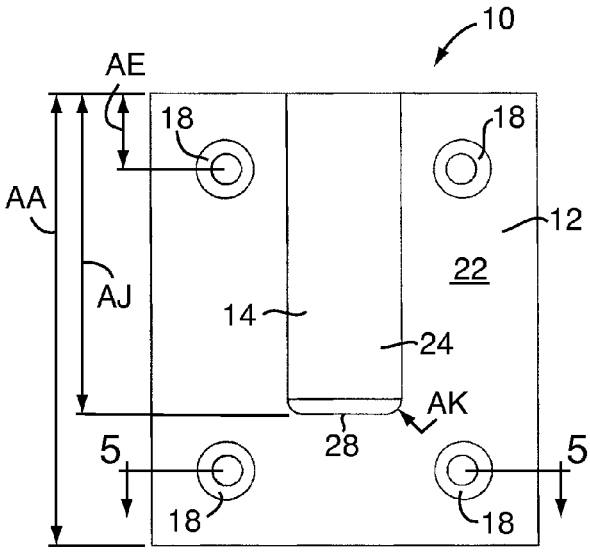
FIG. 2 illustrates the front view of the hanger plate according to the embodiment of FIG. 1.

Referring to FIGS. 1-5, the hanger plate is shown at 10. As shown in FIG. 1, the hanger plate 10 has a body portion 12 and a flange 14 that protrudes from the body portion 12. More specifically, the body portion 12 is substantially rectangular in shape and, although substantially flat, is slightly concave to the front side (e.g., the side facing the drum and the user) (see FIGS. 4 & 5) so that the front facing surface 16 of the body portion 12 is fitted to receive the outer circumferential surface of a drum. As shown in FIG. 2, the body portion 12 includes four through bores 18 positioned towards each corner of its rectangular shape and extending from the rear facing surface (e.g., side pointing away from the user) to the front facing surface 16. The through bores 18 are fitted to receive fasteners, such as a screw and nut assembly (see FIG. 5).

For example, to mount the hanger plate 10 to a drum, fasteners are inserted into the through bores 18, through corresponding holes in the drum and are, then, secured by a nut.

Figure 3:
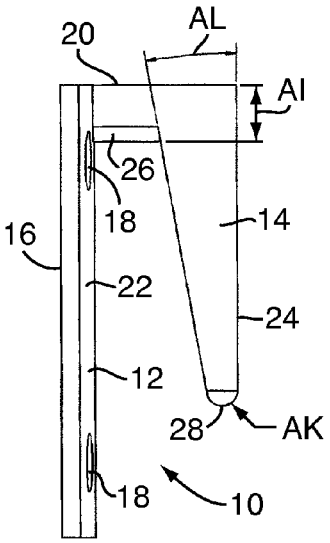
FIG. 3 illustrates a side view of the hanger plate according to the embodiment of FIG. 1.
Figure 4:
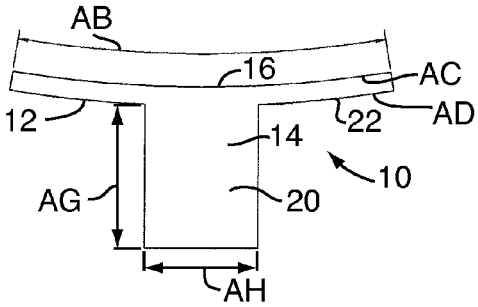
FIG. 4 illustrates the plan view of the hanger plate according to the embodiment of FIG. 1.
Figure 5:
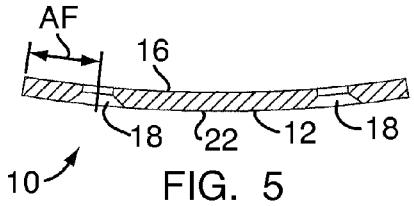
FIG. 5 illustrates a cross section of the hanger plate taken along line 5-5 according to the embodiment of FIG. 2.

As shown in FIG. 3, the flange 14, which protrudes from the body portion 12, is a substantially L-shaped rectangular tab. In particular, the flange 14 has a horizontal stand off portion 20 that extends perpendicularly from the center of the upper edge of the rear facing surface 22 and a downwardly depending portion 24 that extends perpendicularly downward from the stand off portion 20 (for instance, substantially parallel to the front facing surface 16). The stand off portion 20 (see also FIG. 4) is preferably of uniform thickness except for the tapered edges 26 along a bottom surface, (i.e., the tapered edges 26 adjoin the bottom edges of the side surfaces to the bottom surface of the stand off portion 20). In comparison, the downwardly depending portion 24 is preferably a substantially right-angled triangle in shape, for instance, being thicker toward its base near the stand off portion 20 and tapered at the distal end. The distal end of the downwardly depending portion 24 concludes in a rounded tip 28. Preferably, the stand off portion 20 is shorter than the downwardly depending portion 24, which is shorter than the corresponding dimension of the body portion 12.

For example, in the preferred embodiment, the hanger plate 10 has the following dimensions and measurements to mount to a drum having an outer cylindrical surface with an 8.0 inch radius.

The body portion 12 has a height of 3.0 inches (AA) and is 0.130 inches thick, for instance, the curvature of the body portion 12 comprises an 18.0 degree (AB) section of a curved sheet having an inner radius of 8.0 inches (AC) and an outer radius of 8.130 inches (AD). In other words, the body portion 12 is approximately 2.5 inches wide along the curved surface. The through bores 18 are positioned 0.5 inches (AE) from the vertical edges of the body portion 12 and 3.48 degrees (AF) inward (along a 8.0 inch radius guide coinciding with curved surface measured by AC) from the horizontal edges of the body portion 12, which is approximately 0.5 inches along the curved surface. Also, the through bores are shaped and sized to receive fasteners.

The stand off portion 20 of the flange 14 protrudes 0.950 inches (AG) from the front facing surface 16 of the body portion 12, is 0.75 inches (AH) wide, and is 0.4 inches (AI) tall along its uniform thickness portion between the tapered edges 26. Whereas the downwardly depending portion is 2.1 inches (AJ) tall and concludes, at the distal end, with a semi-cylindrical rounded tip 28 having a 0.1 radius (AK). The taper of the downwardly depending portion 24 extends from the rounded tip 28 up to the stand off portion 20 at a 10 degree (AL) angle from the front facing surface 16 (i.e., the vertical axis).

Figure 6:
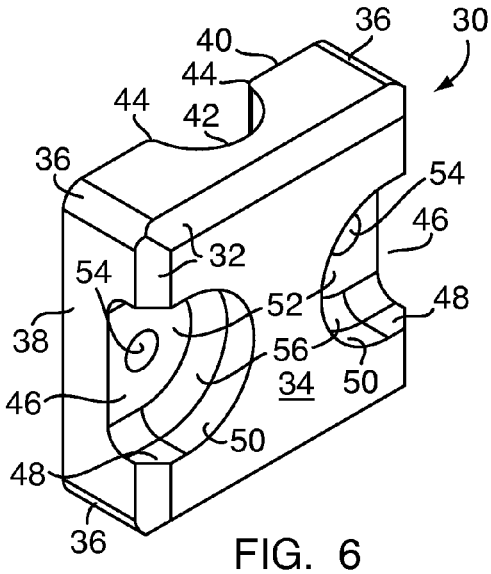
FIG. 6 illustrates a perspective view of the rear clamp of a first embodiment of the present invention.
Figure 7:
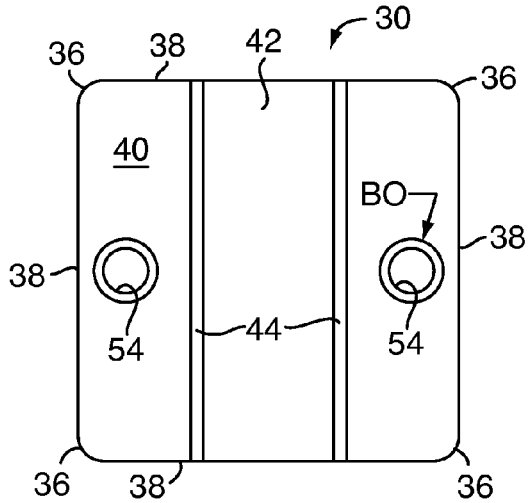
FIG. 7 illustrates the front view of the rear clamp according to the embodiment of FIG. 6.

Referring now to FIGS. 6-10, the rear clamp is shown at 30. As shown in FIG. 6, the rear clamp 30 has a substantially box-shaped body having angled tapered edges 32 on the substantially square rear facing surface 34 and rounded tapered edges 36 adjoining the side facing surfaces 38. In comparison, the front facing surface 40, as shown in FIG. 7, has rounded corners corresponding to the rounded tapered edges 36, but is otherwise substantially square and not tapered.

Figure 10:
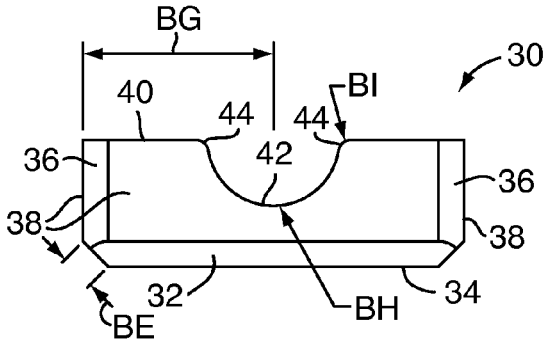
FIG. 10 illustrates a plan view of the rear clamp according to the embodiment of FIG. 6.

The rear clamp 30 includes a number of recesses. For instance, as shown in FIGS. 7 and 10, a semi-cylindrical rear recess 42 is provided vertically in the center of the front facing surface 40. The rear recess 42 is fitted to receive one side (i.e., a semi-cylindrical half of the cylindrical member) of the holding rod and has rounded edges 44 that smooth the transition from the rear recess 42 to the front facing surface 40.

Figure 8:
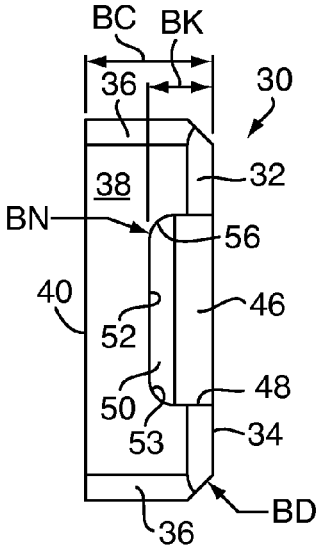
FIG. 8 illustrates a side view of the rear clamp according to the embodiment of FIG. 6.
Figure 9:
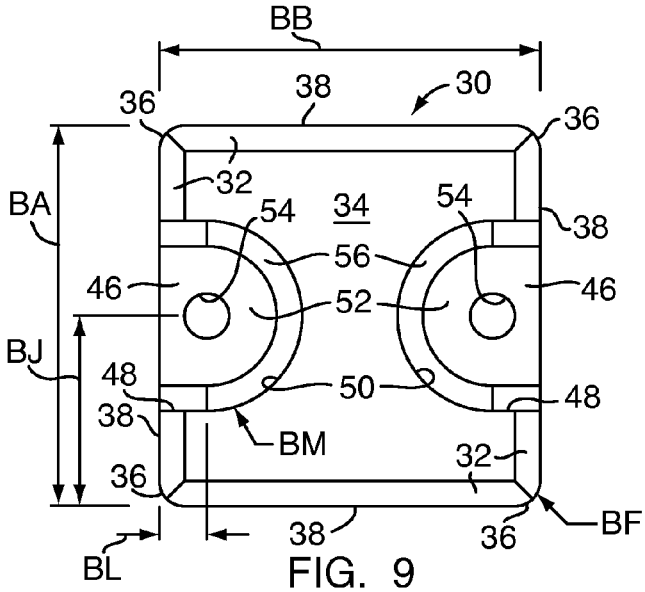
FIG. 9 illustrates the rear view of the rear clamp according to the embodiment of FIG. 6.

As shown in FIGS. 8 & 9, the rear clamp 30 also includes two arcuate recesses 46 positioned near the center of the vertical sides of the rear facing surface 34. The arcuate recesses 46, more specifically, include a rectangular portion 48 that abuts an edge of the rear facing surface 34 and a semi-cylindrical portion 50 that abuts the rectangular portion 48 toward the center of the rear clamp 30 and has a radius equal to half the height of the rectangular portion 48. The rear facing inner surface 52 of the arcuate recesses 46 is substantially parallel to the rear facing surface 34 of the rear clamp 30 with the exception of rounded edges 56 that adjoin the rear facing inner surface 52 to the side walls of the arcuate recess 46. The arcuate recesses 46 include through bores 54 to receive fasteners. The through bores 54 are positioned at the axial center of the semi-cylindrical portion 50 and are wider at the front facing surface 40 and narrower at the rear facing surface 34. In general, the arcuate recesses 46 are shaped to loosely envelop the head of the fastener and shield the fastener from unintended actuation.

For example, in the preferred embodiment, the rear clamp 30 has the following dimensions and measurements to couple with a front clamp (see FIGS. 11-15) or cantilever clamp (see FIGS. 16-20) in order to mount to a holding rod having a radius of 0.3 inches.

The rear clamp 30 has a box-shaped body that is 1.5 inches (BA) in height and 1.5 inches (BB) in width, as observed from the front or rear facing surfaces 40, 34, and is 0.5 inches (BC) long/deep, as observed from the side facing surfaces. The angled tapered edges 32 are angled at 45 degrees (BD) to the rear facing surface 40 and are approximately 0.1 inches (BE) in length/depth. In comparison, the rounded tapered edges 36 between side facing surfaces 38 are annular and have a radius of 0.1 inches (BF).

The rear recess 42 is positioned 0.75 inches (BG) from both vertical side surfaces and has a radius of 0.3 inches (BH), which is centered in the plane of the front facing surface 40 of the rear clamp 30. The rounded edges 44 of the rear recess 42 coincide with a radius of 0.05 inches (BI).

The arcuate recesses 46 are positioned at the vertical midpoint of the rear facing surface 34, for instance, 0.8 inches (BJ) from the top and bottom of the rear clamp 30, and along each edge. The arcuate recesses 46 are a maximum of 0.8 inches tall and 0.3 inches (BK) long/deep. Also, the rectangular portion 48 is 0.2 inches (BL) wide, and the semi-cylindrical portion 50 has a radius of 0.4 inches (BM). The rounded edges 56 are annular and have a radius of 0.1 inches (BN). The through bores 54, which are conical, have a radius of 0.2 inches along the front facing surface and taper to a 0.1 radius (BO) at the front facing inner surface 50 of the arcuate recesses 46.

Figure 11:
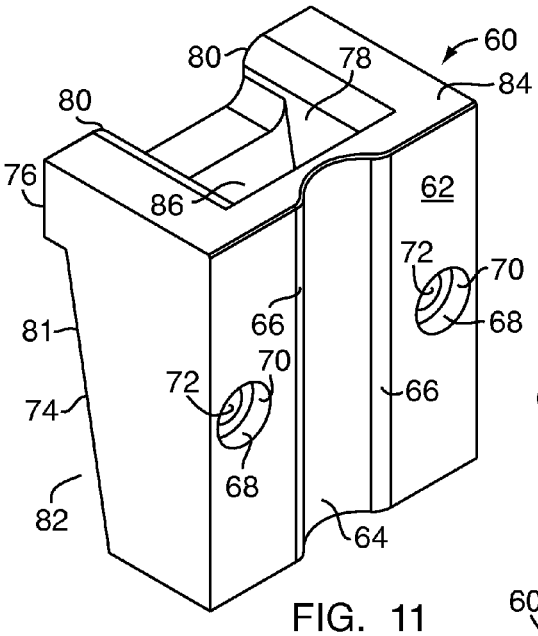
FIG. 11 illustrates a perspective view of the front clamp of a first embodiment of the present invention.

Referring now to FIGS. 11-15, the front clamp is shown at 60. As shown in FIG. 11, the front clamp 60 is a substantially right-angled trapezium shaped member, at least as observed from a side view (see also FIG. 13).

Figure 12:
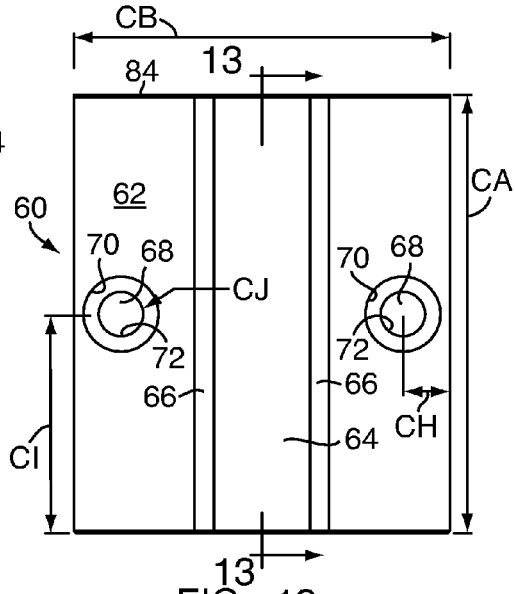
FIG. 12 illustrates the rear view of the front clamp according to the embodiment of FIG. 11.
Figure 15:
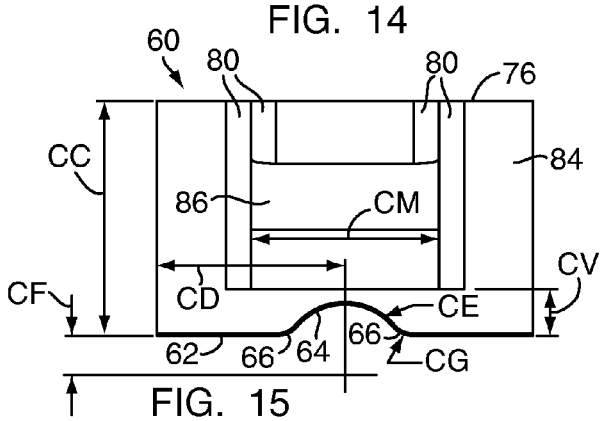
FIG. 15 illustrates a plan view of the front clamp according to the embodiment of FIG. 11.
Figure 16:
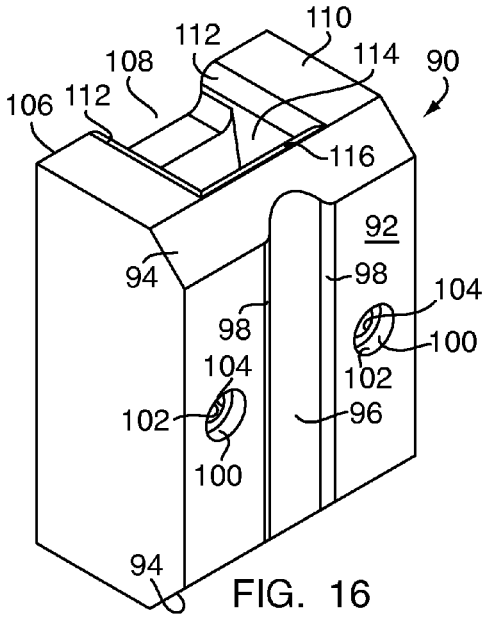
FIG. 16 illustrates a perspective view of the front clamp of a second embodiment of the present invention.

The rear facing surface 62 of the front clamp 60, as shown in FIG. 12, is substantially rectangular and includes a centrally positioned vertical cylindrical front recess 64 for engaging the opposing side (i.e., substantially a semi-cylindrical half of the cylindrical member) of the holding rod, relative to the rear recess of the rear clamp. However, as shown in FIG. 15, in contrast to the rear recess, the front recess 64 is less than semi-cylindrical (i.e., a cylindrical section of less than 180 degrees) in shape. In other words, the axis of the cylindrical shape is positioned away from the rear facing surface 62 of the front clamp 60. Also, the radius of the front recess 64 is slightly smaller than that of the rear recess, but does have rounded edges 66 like the rear recess. The rear facing surface 62 of the front clamp 60, as shown in FIG. 12, also includes two bores 68 that correspond to the through bores of the rear clamp. The bores 68 have an enlarged outer recess 70 for guiding the insertion of the fastener and an inner recess 72 fitted to receive the fastener that is inserted through the through bores and into the bores 68.

Accordingly, the rear facing surface 62 of the front clamp 60 and the front facing surface of the rear clamp are faced opposite one another to securely engage the holding rod when fasteners are inserted through the through bores and into the bores 68 and, then, tightened. When the front clamp 60 and rear clamp are in locked engagement using fasteners, the rear facing surface 62 of the front clamp 60 and the front facing surface of the rear clamp are separated by a narrow gap and do not make contact with one another. In addition, it should be appreciated that, when the fasteners are loosely in place, the bracket (including a rear clamp and a front clamp 60) can be readily mounted to the holding rod by aligning the lower opening of the central vertical cylindrical recesses with the exposed end of the holding rod, sliding the bracket along the holding rod and, then, tightening the fasteners.

Figure 14:
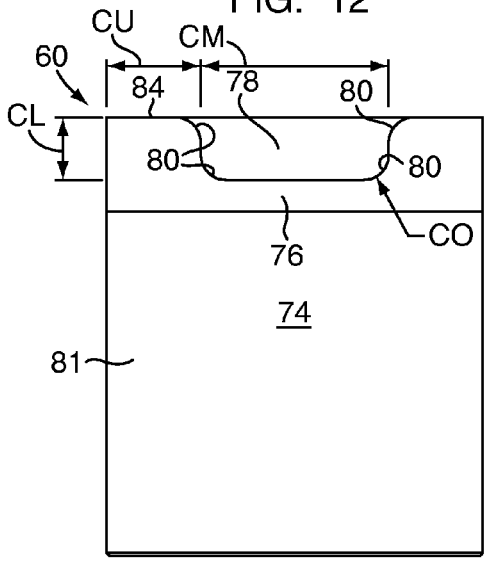
FIG. 14 illustrates the front view of the front clamp according to the embodiment of FIG. 11.

As shown in FIG. 14, the front facing surface 74 of the front clamp 60, which appears substantially rectangular from the front view, includes a horizontal ledge 76 having a rectangular horizontal recess 78 that extends across an upper end of the front facing surface 74. The horizontal recess 78 has rounded edges 80 and is fitted to receive the stand off portion of the hanger plate. The front facing surface 74 also includes a rearward trailing sloping surface 81 (see FIG. 13) that slopes rearward from the horizontal ledge 76 as the sloping surface 81 approaches the bottom of the front clamp 60. The sloping surface 81 corresponds to a carve out 82 from the body of the front clamp 60, which is provided, in part, to reduce the mass of the bracket, in general.

Figure 13:
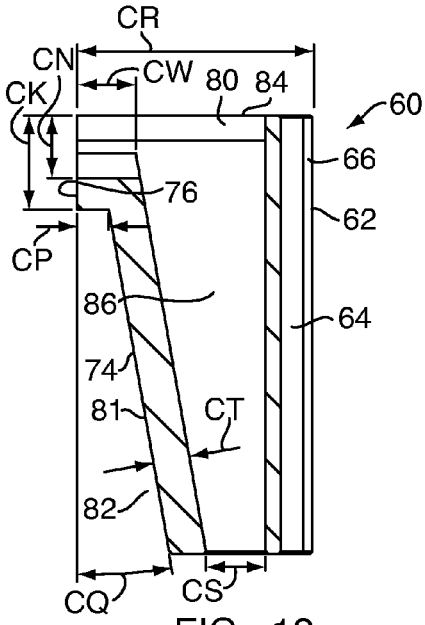
FIG. 13 illustrates a cross section of the front clamp taken along line 13-13 according to the embodiment of FIG. 12.

The top surface 84 of the front clamp 60, which appears substantially rectangular from the plan view (see FIG. 15), houses the opening of a substantially right-angled trapezium shaped front cavity 86. The front cavity 86, as shown in FIG. 13, extends from the top surface 84 through to the bottom surface of the front clamp 60, adjoins the horizontal recess 78 and is fitted to receive the downwardly depending portion of the flange of the hanger plate. For instance, the rearward and frontward walls of the front cavity 86 are substantially parallel to the rear facing surface 62 and the sloping surface 81 of the front clamp 60, respectively. However, the front cavity 86 is also sized so that a lower end of the downwardly depending portion protrudes from the opening of the front cavity 86 in the bottom surface of the front clamp 60.

Accordingly, the front clamp 60 is capable of receiving the flange of the hanger plate, for instance, the horizontal recess 78 is fitted to receive the stand off portion and the front cavity 86 is fitted to receive the downwardly depending portion.

For example, in the preferred embodiment, the front clamp 60 has the following dimensions and measurements to couple with a rear clamp (see FIGS. 6-10) in order to mount to a holding rod having a radius of 0.3 inches.

The front clamp 60 is approximately 1.8 inches (CA) tall, 1.5 inches (CB) wide and a maximum of 0.9 inches (CC) long/deep across the top surface 84. The front recess 64 is positioned 0.8 inches (CD) from the sides of the rear facing surface 62 and is shaped to correspond to a cylindrical body having a radius of 0.3 inches (CE) and axially centered 0.1 inches (CF) perpendicularly away from the rear facing surface 62. In addition, the rounded edges 66 are shaped to have a radius of 0.1 inches (CG). The bores 68 are positioned 0.2 inches (CH) from the vertical sides of the rear facing surface 62 and 0.9 inches (CI) from the top surface 84 and bottom surface of the front clamp 60. Each bore 68 includes a 0.2 inch radius by 0.1 inch deep cylindrical outer recess 72 and a 0.1 inch radius by 0.6 inch deep cylindrical inner recess 70 (CJ).

The horizontal ledge 76 of the front facing surface 74 is 0.4 inches (CK) tall and is as wide as the rear facing surface 62 (e.g., 1.5 inches (CB)). The horizontal recess 78, which is centrally located in the upper surface of the horizontal ledge 76, is 0.3 inches (CL) tall, 0.8 inches (CM) wide and 0.3 inches (CN) long/deep. The rounded edges 80 of the horizontal recess 78 are shaped to fit a circle having a radius of 0.1 inches (CO). Below the horizontal ledge 76, the sloping surface 81 is recessed 0.1 inches (CP) from the front facing surface 74 and extends rearward at a 10 degree (CQ) slope from the vertical front facing surface 74.

The opening of the front cavity 86 in the top surface 84, which adjoins the horizontal recess 78, is 0.8 inches wide (CM) and a total of 0.8 inches deep (CR), which is inclusive of the 0.3 inches (CW) depth of the horizontal recess 78. The front cavity 86 extends downward the entire height of the front clamp 60 (e.g., 1.5 inches (CA) tall) to an opening on the bottom surface. The opening of the front cavity 86 in the bottom surface is also 0.8 inches wide (CM), but is only 0.2 inches (CS) deep since the front cavity 86 is tapered.

In addition, the body of the front clamp 60 is a uniform 0.1 inches (CT) thick from the front wall of the front cavity 86 to the sloping surface 81, 0.4 inches thick (CU) from the side walls of the front cavity 86 to the outer side surfaces, and 0.2 inches thick (CV) from the rear wall of the front cavity 86 to the rear facing surface 62.

Referring now to FIGS. 16-20, an alternative embodiment of the front clamp (see FIGS. 11-15) is provided. In particular, a cantilever clamp is shown at 90 in FIG. 16. The cantilever clamp 90 is similar to the front clamp (discussed above) in many ways. However, the cantilever clamp 90 is larger and heavier than the front clamp in order to provide a sufficient amount of weight to balance a larger or heavier drum on the drum stand.

Figure 17:
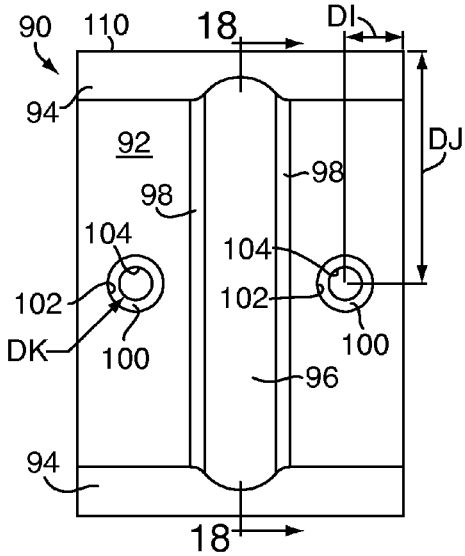
FIG. 17 illustrates the rear view of the front clamp according to the embodiment of FIG. 16.

As shown in FIG. 17, the rear facing surface 92 of the cantilever clamp 90 is substantially rectangular and abuts angled tapers 94 along the top and bottom edges of the rear facing surface 92. A centrally positioned vertical cylindrical cantilever recess 96 (see FIG. 20) is provided in the rear facing surface 92 of the cantilever clamp 90 for engaging the opposing side of the holding rod as the rear clamp. However, like the front recess of the front clamp, the cantilever recess 96 of the cantilever clamp 90 is less than semi-cylindrical (i.e., a cylindrical section of less than 180 degrees) in shape. In other words, the axis of the cylindrical recess 96 is positioned away from the rear facing surface 92. The radius of the cantilever recess 96 of the cantilever clamp 90 is slightly smaller than that of the rear recess of the rear clamp, but has rounded edges 98 that are at least as rounded as the rounded edges of the rear clamp. As shown in FIG. 17, the rear facing surface 92 of the cantilever clamp 90 includes two bores 100 that correspond to the through bores of the rear clamp. The bores 100 have an enlarged outer recess 102 for guiding the insertion of the fastener and an inner recess 104 fitted to receive the fastener, which is inserted through the through bores and into the bores 100.

Accordingly, the rear facing surface 92 of the cantilever clamp 90 and the front facing surface of the rear clamp are fitted to securely engage the holding rod by inserting fasteners through the through bores, into the bores 100 and, then, tightening the fasteners. When the cantilever clamp 90 and rear clamp are securely engaged, the rear facing surface 92 of the cantilever clamp 90 and the front facing surface of the rear clamp are separated by a narrow gap and do not make contact with one another. In addition, it should be appreciated that, when the fasteners are loosely provided in the bores 100 and through bores, the bracket (including the cantilever clamp 90 and the rear clamp) can be mounted to the holding rod by aligning the lower opening of the cantilever recess 90 and rear recess with the exposed end of the holding rod, sliding the bracket along the holding rod and, then, tightening the fasteners.

Figure 19:
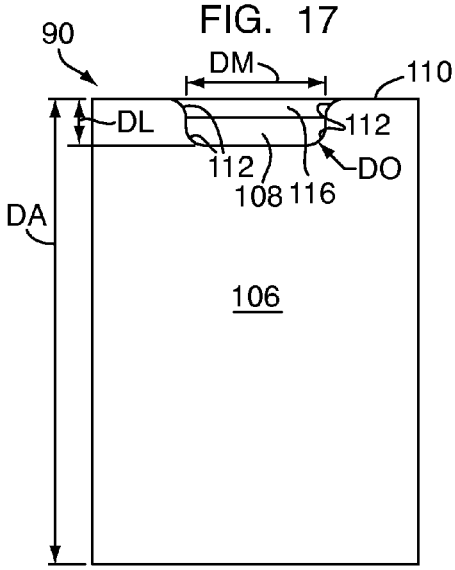
FIG. 19 illustrates the front view of the front clamp according to the embodiment of FIG. 16.

As shown in FIG. 19, the front facing surface 106 of the cantilever clamp 90, which appears substantially rectangular from the front view, includes a horizontal recess 108 that extends across part of the top surface 110 of the front facing surface 106. The horizontal recess 108 of the cantilever clamp 90 has rounded edges 112 and is fitted to receive the stand off portion of the hanger plate. However, unlike the front clamp, the cantilever clamp 90 does not have a sloping surface or a cut out. Instead, the front facing surface 106 is substantially flat, which provides additional mass to the cantilever clamp 90 design in order to balance the weight of the drum on the drum stand.

Figure 18:
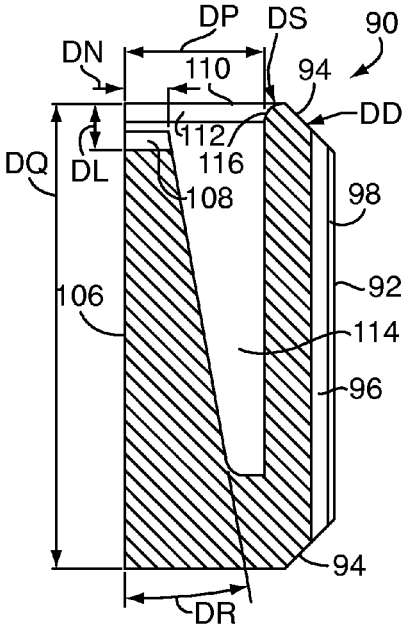
FIG. 18 illustrates a cross section of the front clamp taken along line 18-18 according to the embodiment of FIG. 17.
Figure 20:
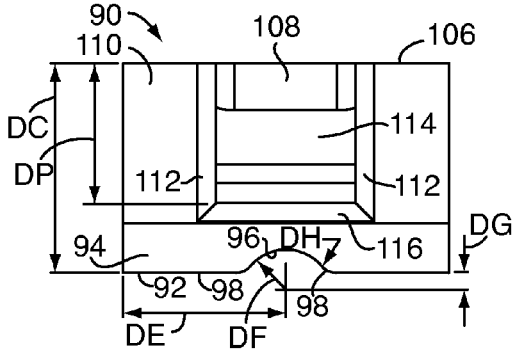
FIG. 20 illustrates a plan view of the front clamp according to the embodiment of FIG. 16.
Figure 21:
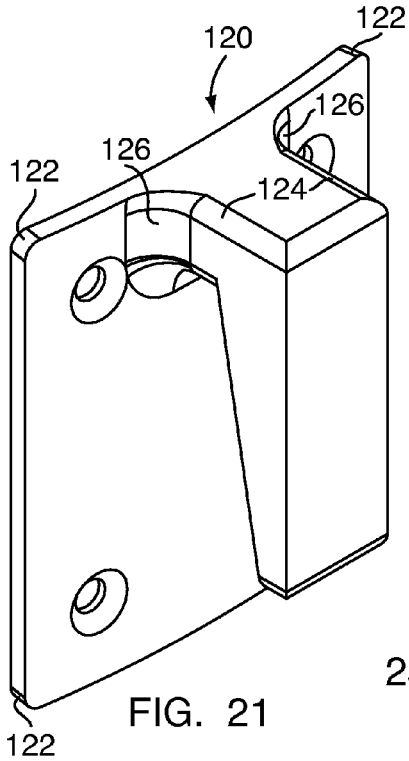
FIG. 21 illustrates a perspective view of the hanger plate having rounded contours according to the first embodiment of the present invention.
Figure 22:
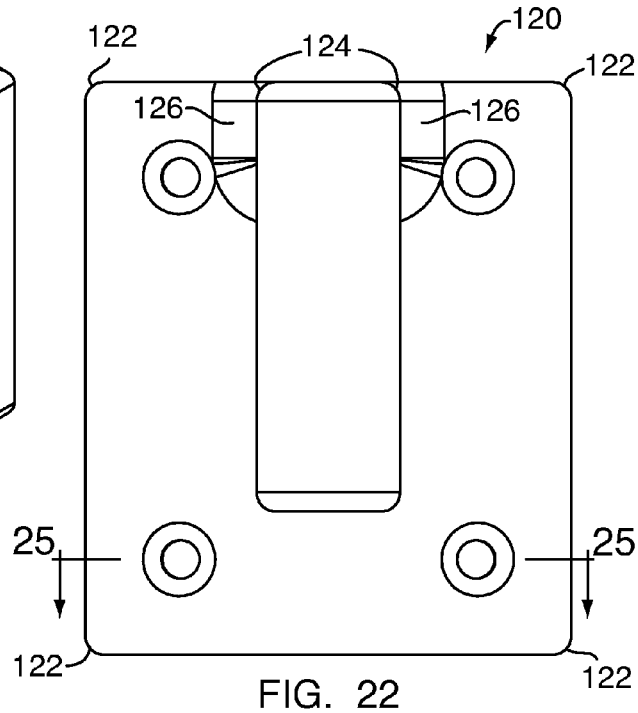
FIG. 22 illustrates the front view of the hanger plate having rounded contours according to the embodiment of FIG. 21.
Figure 23:
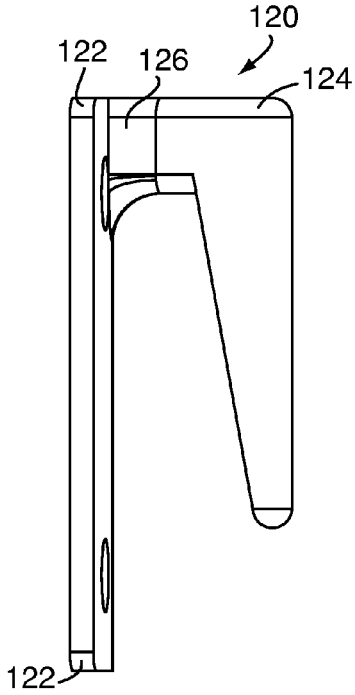
FIG. 23 illustrates a side view of the hanger plate having rounded contours according to the embodiment of FIG. 21.
Figure 24:
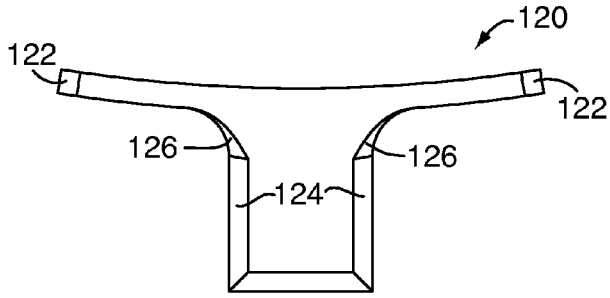
FIG. 24 illustrates the plan view of the hanger plate having rounded contours according to the embodiment of FIG. 21.
Figure 25:
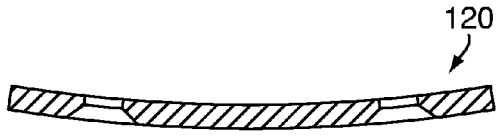
FIG. 25 illustrates a cross section of the hanger plate having rounded contours taken along line 25-25 according to the embodiment of FIG. 22.

As shown in FIGS. 18 & 20, the top surface 110 of the cantilever clamp 90, which appears substantially rectangular from the plan view, houses the opening of a substantially right-angled trapezium shaped cantilever cavity 114. The cantilever cavity 114, which adjoins the horizontal recess 108 and is fitted to receive the downwardly depending portion of the flange of the hanger plate, extends from the top surface 110 into the body of the cantilever clamp 90. However, unlike the front cavity of the front clamp, the cantilever cavity 114 of the cantilever clamp 90 does not extend through to the bottom surface. Instead, the cantilever cavity 114 is fully enveloped by the cantilever clamp 90 with the exception of the opening on the top surface 110. Also, a smooth edge 116 is provided to the rear of the cantilever cavity 114 to facilitate insertion of the flange into the cantilever cavity 114.

Accordingly, the cantilever clamp 90 is capable of receiving the flange of the hanger plate, for instance, the horizontal recess 108 is fitted to receive the stand off portion and the cantilever cavity 90 is fitted to receive the downwardly depending portion.

For example, in the preferred embodiment, the cantilever clamp 90 has the following dimensions and measurements to couple with a rear clamp (see FIGS. 6-10) in order to mount to a holding rod having a radius of 0.3 inches.

The cantilever clamp 90 is approximately 2.5 inches (DA) tall, 1.75 inches (DB) wide and a maximum of 1.1 inches (DC) long/deep. The angled tapers 94 along the top and bottom of the rear facing surface 92 extend across the width of the cantilever clamp 90, are angled at substantially 45 degrees to the rear facing surface 92 and are 0.4 inches (DD) deep. The cantilever recess 90 is positioned 0.9 inches (DE) from the sides of the rear facing surface 92 and is annular, having a radius of 0.3 inches (DF) and being axially centered 0.1 inches (DG) perpendicularly away from the rear facing surface 92. In addition, the rounded edges 98 are shaped to have a radius of 0.1 inches (DH). The bores 100 are positioned 0.3 inches (DI) from the vertical sides of the rear facing surface 92 and 1.3 inches (DJ) from the top and bottom surfaces of the cantilever clamp 90. Each bore 100 includes a 0.2 inch radius by 0.1 inch deep cylindrical outer recess 102 and a 0.1 inch radius by 0.6 inch deep cylindrical inner recess 104 (DK).

The horizontal recess 108, which is centrally located along the upper edge of the front facing surface 106, is 0.3 inches (DL) tall, 0.8 inches (DM) wide and 0.3 inches (DN) long/deep. The rounded edges 98 of the horizontal recess 108 have a radius of 0.1 inches (DO).

The opening of the cantilever cavity 90, which adjoins the horizontal recess 108, in the top surface 110 is 0.8 inches wide (DM) and a total of 0.8 inches deep (DP), which is inclusive of the 0.3 inches (DN) depth of the horizontal recess 108. The cantilever cavity 90 extends 2.0 inches (DQ) downward into the body of the cantilever clamp 90 and the front wall is angled at 10 degrees (DR) to correspond to the slope of the downwardly depending portion of the flange. In addition, the rounded edge 98 to the rear of the cantilever cavity 90 is rounded to have a radius of 0.1 inches (DS).

The hanger plate, rear clamp and front clamp (or cantilever clamp) can be made from a number of sufficiently robust materials (e.g., high-density plastics, carbon fiber and metals) and using a number of methods (e.g., stamping, molding, sand casting and die casting) to suit the material. In the preferred embodiment, the elements are made from die cast zinc.

The mount of the present invention improves upon the prior art in a number of ways by providing a mount that runs counter to the common knowledge and beliefs of those in the art. In particular, the mount of the present invention utilizes an hanger plate and a bracket that loosely engage one another (i.e., which are not fixedly attached). The flange of the hanger plate merely rests inside the cavity of the bracket, thereby connecting the object to the supporting structure under the weight of the object.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention in the above detailed description, but that the invention will include all embodiments falling within the scope of this disclosure.

For example, the engagement of the hanger plate to the front clamp or cantilever clamp can by modified to provide a securing means that limits the removal of the hanger plate from the clamp. The securing means can include, for example, a detent spring arrangement, a magnet (or an opposing pair of magnets), a mechanical latch, a clamp, a cam surface or an adjustable screw lock.

The edges of the mount may also be contoured in order to, among other things, reduce the weight of the mount, reduce the amount of material used to manufacture the mount and improve the aesthetic appeal of the mount. For example, as shown in FIGS. 21-25, a hanger plate having a body portion with rounded corners 122 and a flange with rounded edges 124 along its top surface is shown at 120. The hanger plate 120 also has a rounded connection 126 between the body portion and the stand off portion of the flange. Corresponding adjustments to the horizontal recess of the front clamp or cantilever clamp would also be provided in such a mount having contoured edges.

In addition, the mount of the present invention is equally applicable and functional for supporting a vast array of objects, including musical instruments and any number of other mountable objects, to a vast array of supporting structures, including instrument stands and any number of other structures. It should be appreciated that the mount can be reshaped and resized to be utilized in other settings.

What is claimed is:

1. A mount for affixing an object to a support structure, comprising:

a hanger plate having a body portion including a front surface for affixing to the object and a substantially L-shaped flange protruding from a rear surface of the body portion; and a bracket affixed to the support surface and having a substantially vertical cavity fitted to receive the flange;

wherein the object is supported adjacent to the support structure when the flange is inserted into the cavity.

2. The mount according to claim 1, wherein the body portion is fitted to receive an outer surface of the object.

3. The mount according to claim 2, wherein the flange comprises:

a stand off portion that extends substantially perpendicularly from the rear facing surface; and a downwardly depending portion that extends substantially perpendicularly downward from the stand off portion.

4. The mount according to claim 3, wherein the stand off portion includes an angular taper along a bottom surface; and wherein the downwardly depending portion is substantially triangular and concludes in a rounded tip.

5. The mount according to claim 1, wherein the bracket further comprises:

a rear clamp having a rear recess for receiving a holding rod that extends from the support structure;

a front clamp opposing the rear clamp and having a front recess for receiving an opposing side of the holding rod; and fasteners for connecting the rear clamp and the front clamp in adjustable locking engagement.

6. The mount according to claim 5, wherein the front clamp is a cantilever clamp.

7. The mount according to claim 5, wherein the front clamp includes a horizontal ledge protruding from a front facing surface and having a horizontal recess with rounded edges fitted to receive a stand off portion of the flange.

8. The mount according to claim 5, wherein the front clamp has a sloping surface that is substantially parallel to a downwardly depending portion of the flange.

9. The mount according to claim 5, wherein the front clamp has a securing means for resisting the detachment of the hanger plate from the front clamp.

10. The mount according to claim 2, wherein the hanger plate has a height in the range of 2.5 inches to 3.5 inches, a width in the range of 2.0 inches to 3.0 inches and a thickness of 0.10 to 0.20 inches.

11. The mount according to claim 3, wherein the stand off portion protrudes from the body portion in the range of 0.5 inches to 1.5 inches and the downwardly depending portion extends downward from the stand off portion in the range of 1.0 inches and 2.6 inches.

12. The mount according to claim 4, wherein the rear clamp has a height in the range of 1.0 inches to 2.0 inches, a width in the range of 1.0 inches to 2.0 inches and a thickness in the range of 0.2 to 0.8 inches.

13. The mount according to claim 5, wherein the rear clamp has a height in the range of 1.0 inches to 2.0 inches, a width in the range of 1.0 inches to 2.0 inches and a thickness in the range of 0.2 to 0.8 inches.

14. The mount according to claim 4, wherein the front clamp has a height in the range of 1.2 inches to 2.3 inches, a width in the range of 1.0 inches to 2.0 inches, a maximum thickness in the range of 0.4 inches to 1.5 inches and a minimum thickness in the range of 0.2 inches to 0.8 inches.

15. The mount according to claim 4, wherein the front clamp includes a sloping section having a thickness in the range of 0.1 to 0.2 inches.

16. The mount according to claim 5, wherein the cantilever clamp has a height in the range of 2.0 to 3.0 inches, a width in the range of 1.2 inches to 2.3 inches and a thickness in the range of 0.6 inches to 1.6 inches.

17. A rack comprising:

at least one holding rod;

at least one bracket affixed to the at least one holding rod having a cavity;

at least one hanger plate having a flange that protrudes from the at least one hanger plate and is fitted to the cavity; and at least one object affixed to a body portion of the hanger plate, wherein the at least one object is supported adjacent to the rack when the flange is inserted into the cavity.

18. The rack according to claim 17:

wherein one of the at least one object is a drum.

19. A rack according to claim 17, wherein the at least one bracket comprises:

a rear clamp having a rear recess for receiving a side of the at least one holding rod; and a front clamp opposing the rear clamp and having a front recess for receiving an opposing side of the at least one holding rod;

wherein the at least one hanger plate comprises a body portion fitted to receive an outer circumferential surface of the drum; and wherein the flange is substantially L-shaped and comprises:

a stand off portion that extends substantially perpendicularly from the body portion; and a downwardly depending portion that extends substantially perpendicularly downward from the stand off portion.

20. A mount for affixing an instrument to an instrument stand, wherein the instrument has an outer cylindrical surface and the instrument stand supports at least one holding rod, comprising:

an hanger plate having a substantially rectangular body portion fitted to receive the outer cylindrical surface of the drum and an L-shaped flange, wherein the flange comprises:

a stand off portion that extends perpendicularly outward from the body portion away from the instrument, wherein the stand off portion is a substantially uniform thickness rectangular member with tapered edges along a bottom surface; and a downwardly depending portion extending downward from the stand off portion, wherein the downwardly depending portion is a substantially right angled triangular member that concludes in a rounded tip; and a bracket for mounting to the at least one holding rod comprising:

a rear clamp having a front facing surface that includes a substantially vertical cylindrical rear recess for receiving a side of the at least one holding rod and at least one through bore;

a front clamp having a rear facing surface that opposes the front facing surface, the rear facing surface including a substantially vertical cylindrical front recess for receiving an opposing side of the at least one holding rod and at least one bore corresponding to the at least one through bore, and a top surface that includes a horizontal recess fitted to receive the stand off portion and a cavity fitted to receive the downwardly depending portion and abutting the horizontal recess; and at least one fastener for connecting the rear clamp and the front clamp in adjustable locking engagement, wherein the at least one fastener is inserted through the at least one through bore and into the at least one bore;

whereby the hanger plate is affixed to the bracket by inserting the flange into the horizontal recess and the cavity and the at least one instrument is supported adjacent to the instrument stand when the flange is inserted into the cavity.

* * * * *